US012433403B2

(12) United States Patent
Huffman et al.

(10) Patent No.: US 12,433,403 B2
(45) Date of Patent: Oct. 7, 2025

(54) CORNER CABINET AND CORNER DRAWER

(71) Applicant: CABINETWORKS GROUP, Ann Arbor, MI (US)

(72) Inventors: Acy Huffman, Canton, MI (US); Kevin Ward, Jr., Louisville, KY (US)

( * ) Notice: Subject to any disclaimer, the term of this patent is extended or adjusted under 35 U.S.C. 154(b) by 338 days.

(21) Appl. No.: 17/774,431

(22) PCT Filed: Jun. 12, 2020

(86) PCT No.: PCT/US2020/037547
§ 371 (c)(1),
(2) Date: May 4, 2022

(87) PCT Pub. No.: WO2020/252351
PCT Pub. Date: Dec. 17, 2020

(65) Prior Publication Data

US 2022/0386773 A1 Dec. 8, 2022

Related U.S. Application Data

(60) Provisional application No. 62/860,950, filed on Jun. 13, 2019.

(51) Int. Cl.
*A47B 81/00* (2006.01)
*A47B 77/00* (2006.01)
(Continued)

(52) U.S. Cl.
CPC ..... *A47B 81/002* (2013.01); *A47B 77/00* (2013.01); *A47B 88/42* (2017.01); *A47B 88/48* (2017.01); *A47B 88/70* (2017.01)

(58) Field of Classification Search
CPC ..... A47B 81/002; A47B 88/70; A47B 88/42; A47B 88/48; A47B 77/00
(Continued)

(56) References Cited

U.S. PATENT DOCUMENTS 264,749 A * 9/1882 Potts ..... A47B 53/02 312/285
1,010,950 A 12/1911 Prather
(Continued)

FOREIGN PATENT DOCUMENTS

DE 202018003163 U1 8/2018
WO 2006083507 A2 8/2006

OTHER PUBLICATIONS

International Search Report and Written Opinion corresponding to PCTUS2020/037547, dated Aug. 27, 2020, 25 pages.

*Primary Examiner* — Daniel J Troy
*Assistant Examiner* — Timothy M Ayres
(74) *Attorney, Agent, or Firm* — Harter Secrest & Emery LLP; Timothy W. Menasco, Esq.

(57) ABSTRACT

A corner cabinet drawer (14, 114) includes first and second drawer modules (36*a,b,* 136*a,b*) each including drawer frames (38*a,b,* 138*a*) having side walls (46*a,b* 146*a*), rear walls (52*a,b,* 152*a*), and front walls (54*a,b,* 154*a*), and wherein the drawer modules are pivotable between a side-by-side closed position and a spread-apart open position. A corner cabinet (10, 110) includes the corner cabinet drawer translatably and pivotably mounted with respect to a cabinet housing (12), and including drawer articulators (40*a,b,* 41*a,b,* 60*a,b,* 140*a,* 141*a,* 160*a,b*) coupled to the cabinet housing and to the drawer, wherein the first and second drawer modules are translatable via the drawer articulators from a stored position with respect to the cabinet housing to the extended closed position and the spread-apart open position. Aspects of individual drawer modules are also disclosed.

17 Claims, 9 Drawing Sheets

(51) Int. Cl.
*A47B 88/42* (2017.01)
*A47B 88/48* (2017.01)
*A47B 88/70* (2017.01)

(58) Field of Classification Search
USPC ..... 312/238
See application file for complete search history.

(56) References Cited

U.S. PATENT DOCUMENTS 1,055,109 A * 3/1913 Whitaker ..... A47B 17/036 5/2.1
3,086,546 A 4/1963 Brown
3,902,201 A 9/1975 Bobo
4,145,775 A 3/1979 Butler
4,959,582 A * 9/1990 Meyer ..... A47B 88/60 312/307
4,980,932 A 1/1991 Stemples
5,134,729 A 8/1992 Shaw
5,287,565 A 2/1994 Auman et al.
5,615,936 A * 4/1997 Simmons ..... A47B 17/00 312/238
5,708,991 A 1/1998 DeMarco
5,715,860 A 2/1998 Horad
6,033,046 A * 3/2000 Lambright ..... E06B 5/006 312/310
6,385,788 B1 5/2002 Wasielewski
6,457,278 B1 10/2002 Fleming
6,823,889 B1 11/2004 Schuster
7,047,574 B2 5/2006 Patterson
7,376,984 B2 5/2008 Molter
7,690,739 B2 * 4/2010 Brustle ..... A47B 81/002 312/238
8,083,303 B2 12/2011 Compagnucci
8,277,004 B2 * 10/2012 Chung ..... F25D 23/10 312/405
11,564,490 B1 * 1/2023 Searles ..... A47B 46/00
2005/0280340 A1 12/2005 Brustle et al.
2006/0168716 A1 8/2006 Schuster et al.
2006/0168717 A1 8/2006 Schuster et al.
2012/0298604 A1 11/2012 Fuhrer

* cited by examiner

CORNER CABINET AND CORNER DRAWER

TECHNICAL FIELD

This disclosure relates generally to cabinets and, more particularly, to corner cabinets.

BACKGROUND

Corner cabinets typically include an L-shaped casing establishing an L-shaped interior, and a door having two sections hinged together and disposed at a right angle to one another with one of the sections pivotably hinged to the casing. Also, corner cabinets usually include fixed L-shaped shelving or a Lazy Susan having notched circular shelves carried by the casing in the interior. Although such corner cabinets are widely accepted and successfully commercialized, access to contents in the interior may be difficult and/or utilization of interior storage space may be less than optimal.

BRIEF SUMMARY OF DISCLOSURE

According to an aspect of the present disclosure, a corner cabinet drawer (14, 114) includes first and second drawer modules (36*a,b*, 136*a,b*) each including drawer frames (38*a, b*, 138*a*) having side walls (46*a,b* 146*a*), rear walls (52*a,b*, 152*a*), and front walls (54*a,b*, 154*a*), wherein the drawer modules are pivotable between a side-by-side closed position and a spread-apart open position. According to another aspect of the present disclosure, a corner cabinet (10, 110) includes the corner cabinet drawer translatably and pivotably mounted with respect to a cabinet housing (12), and including drawer articulators (40*a,b*, 41*a,b*, 60*a,b*, 140*a*, 141*a*, 160*a,b*) coupled to the cabinet housing and to the drawer, wherein the first and second drawer modules are translatable via the drawer articulators from a stored position with respect to the cabinet housing to the extended closed position and the spread-apart open position. Aspects of the individual drawer modules are also disclosed.

DETAILED DESCRIPTION

In general, an articulatable corner drawer will be described using one or more examples of illustrative embodiments of a residential kitchen corner cabinet having an L-shape with one leg of the L-shape longer than the other. However, it will be appreciated as the description proceeds that the presently disclosed corner drawer is useful in many different applications and may be implemented in many other embodiments. For example, the corner cabinet may have legs of equal length, and may be used in bathrooms, workshops, or any other location in residential applications, or in any suitable location in hospitals, restaurants, offices, factories, or any other commercial or industrial applications.

Figure 1:
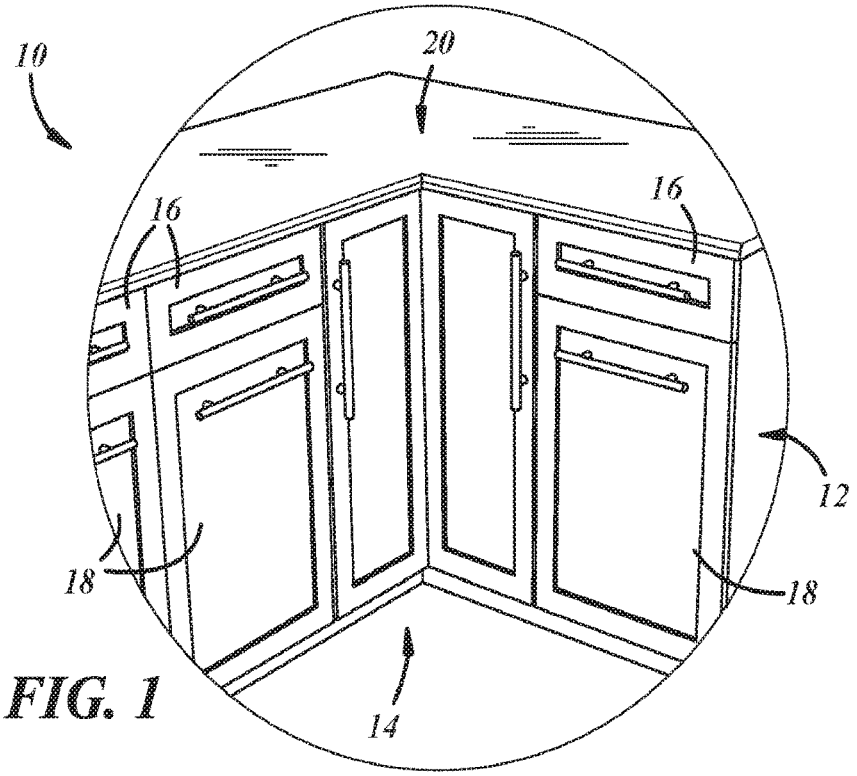
FIG. 1 is a fragmentary perspective view according to an illustrative embodiment of a corner cabinet of the present disclosure, and illustrating a cabinet housing, a countertop, and closed doors and drawers.
Figure 2:
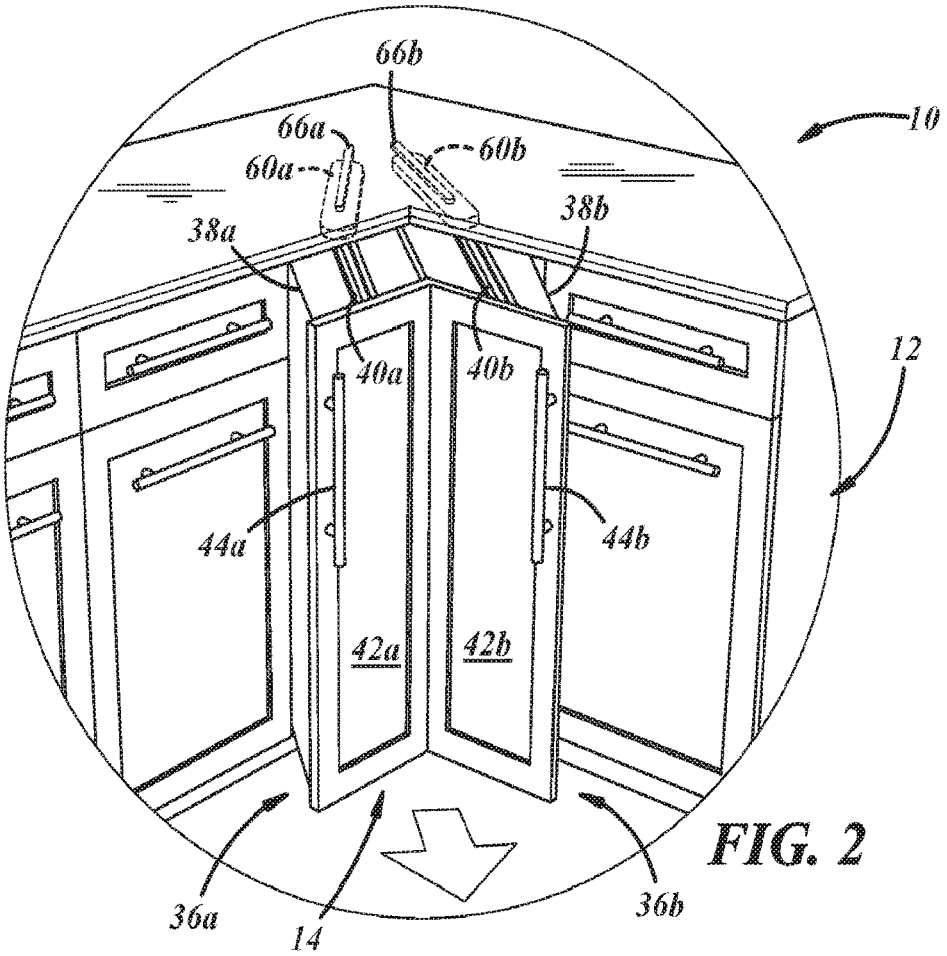
FIG. 2 is a fragmentary perspective view of the corner cabinet of FIG. 1, and illustrating a corner drawer translated outwardly and in a partially extended position.

Referring specifically to the drawings, FIG. 1 shows an illustrative embodiment of a corner cabinet 10 including a casing or housing 12, an articulatable corner drawer 14 translatably and pivotably carried with respect to the housing 12, upper drawers 16 translatably carried by the housing 12 and lower doors 18 pivotably carried by the housing 12 on either side of the corner drawer 14, and a countertop 20 carried on the housing 12. FIG. 2 shows the corner drawer 14 moved partially out of the housing 12

Figure 3:
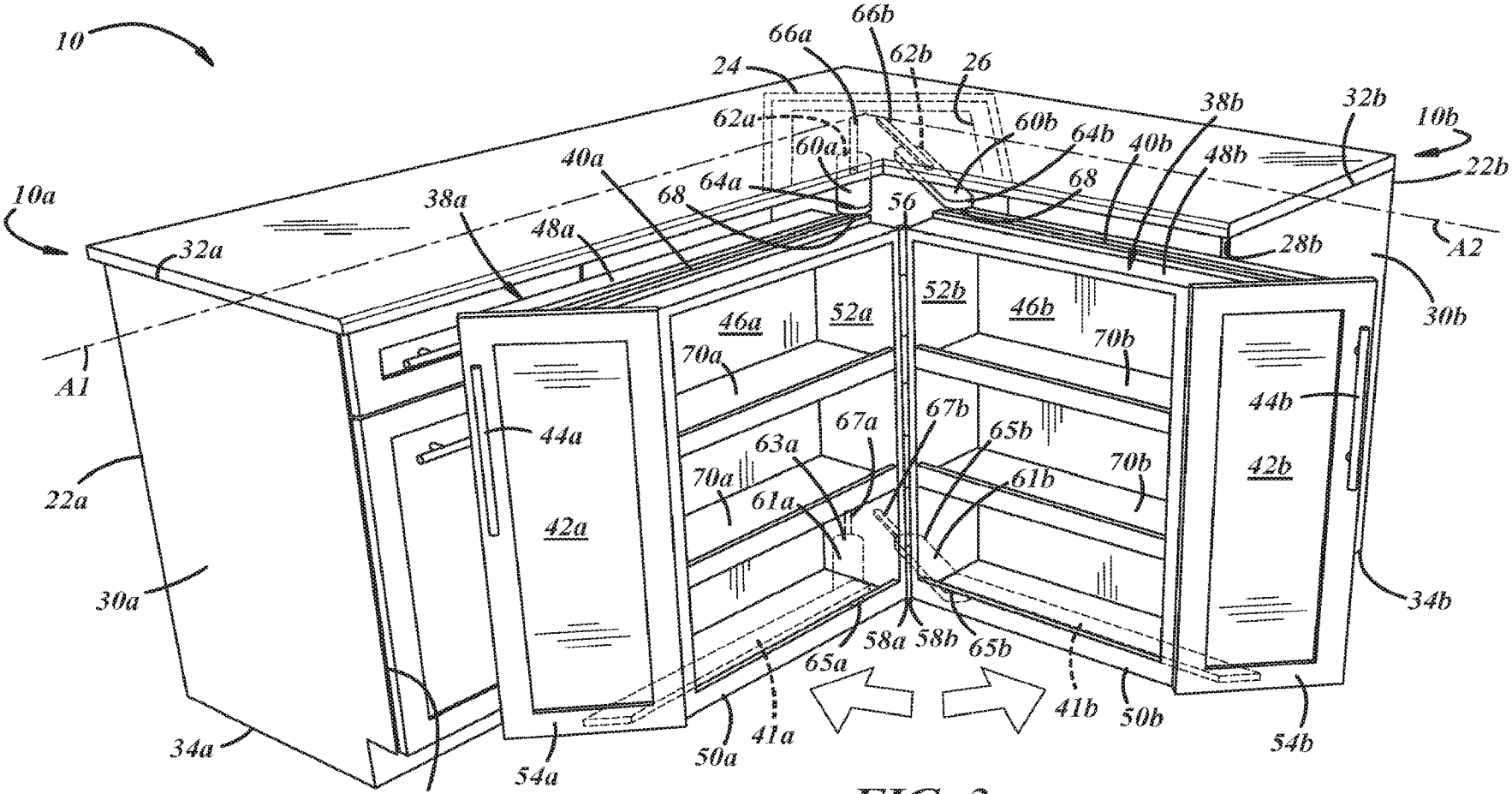
FIG. 3 is a fragmentary perspective view of the corner cabinet of FIG. 1, and illustrating the corner drawer in a deployed position wherein drawer modules have been extended and spread apart.

With reference to FIG. 3, the corner cabinet 10 is L-shaped, having a longer left portion 10*a* that has a first length extending along a first length axis A1, and a shorter right portion 10*b* that has a second length extending along a second length axis A2. Of course, those of ordinary skill in the art will recognize that, in other embodiments, the right portion 10*b* could be longer than the left portion 10*a* or the left and right portions 10*a,b* could be of equal length. The corner cabinet 10 may include left and right rear walls 22*a,b* that may be disposed at a right angle with respect to one another and that may not connect directly to one another, a corner wall 24 that may be disposed at forty-five-degree angles with respect to the rear walls 22*a,b* and that may have a central space or opening 26 to accommodate extension of the corner drawer 14 therethrough. The corner cabinet 10 further may include left and right front walls 28*a,b*, and left and right end walls 30*a,b* extending between the rear and front walls 28*a,b*. The corner cabinet 10 also may include upper and lower walls 32, 34 respectively connecting the other walls, and/or various cross-members, struts, reinforcement members, or the like connecting two or more of the walls. Those of ordinary skill in the art will recognize that the various walls may be panels in and of themselves, or surfaces of panels, or the like.

With continued reference to FIG. 3, the corner drawer 14 includes first and second drawer modules 36*a,b* that may include drawer frames 38*a,b*, upper tracks 40*a,b* and lower tracks 41*a,b* carried by the drawer frames 38*a,b*, and doors 42*a,b* being carried by the drawer frames 38*a,b* and disposed at a right angle with respect to one another and having handles 44*a,b*. The drawer modules 36*a,b* are in a side-by-side facing relationship and are linearly translated out of the housing 12 along a direction that extends at about forty-five-degree angles with respect to the longitudinal/length axes of the left and right portions 10*a,b* of the corner cabinet 10. The drawer frames 38*a,b* each may include a plurality of walls including side walls 46*a,b*, top walls 48*a,b*, bottom walls 50*a,b*, rear walls 52*a,b*, and front walls 54*a,b* disposed at a right angle with respect to one another, wherein the walls establish closed outboard sides and open inboard sides facing one another when in the stored and closed/extended positions of the drawer modules 36*a,b*. The front walls 54*a,b* may be constituted by the doors 42*a,b* or may be separate panels or the like in addition to the doors 42*a,b* and to which the doors 42*a,b* are coupled. The tracks 40*a,b* and 41*a,b* may be fixed to the drawer frames 38*a,b* against movement with respect thereto and may be carried, respectively, by the top walls 48*a,b* and the bottom walls 50*a,b* of the frames 38*a,b*.

FIG. 3 illustrates the corner drawer 14 deployed out of the housing 12. The drawer modules 36*a,b* translate outwardly on the tracks 40*a,b* to an extended position, and then spread apart from one another to an open position, wherein the modules 36*a,b* may be disposed at a right angle with respect to one another. Conversely, the drawer modules 36*a,b* pivotably fold or collapse closed toward one another back to the extended position and then translatably slide inwardly into the cabinet housing 12 back to the stored position of FIG. 1.

In this regard, FIG. 3 also illustrates that the corner drawer 14 may include a hinge 56 pivotably coupling the drawer modules 36*a,b* to one another, for example, at rear inboard corners 58*a,b* thereof. Likewise, FIG. 3 further illustrates that the corner cabinet 10 may include upper drawer supports 60*a,b* having cabinet ends 62*a,b* coupled to an undersurface of the countertop and/or to an upper frame portion of the cabinet housing 12, and oppositely disposed drawer ends 64*a,b* translatably and pivotably coupled to the upper tracks 40*a,b* to allow the drawer modules 36*a,b* to be translated and pivoted outwardly. Likewise, the corner cabinet 10 also may include lower drawer supports 61*a,b* having cabinet ends 63*a,b* coupled to a floor or a lower frame portion of the cabinet housing 12 and oppositely disposed drawer ends 65*a,b* translatably and pivotably coupled to the lower tracks 41*a,b* to allow the drawer modules 36*a,b* to be translated and pivoted outwardly. Additionally, the cabinet ends 62*a,b* of the supports 60*a,b* may be fixed to the cabinet 12 against translation and/or rotation of the supports 60*a,b* relative to the cabinet 12. Or, as illustrated, the cabinet ends 62*a,b* may be retained to the cabinet 12 but in a manner suitable to allow translation of the upper and lower supports 60*a,b* and 61*a,b*, for example, by being translatably carried on upper and lower tracks 66*a,b* and 67*a,b* that may be fixed to the cabinet 12, or in any other manner suitable to allow translation and/or rotation of the supports 60*a,b* and 61*a,b* relative to the cabinet 12.

The supports 60*a,b* and 61*a,b* may include brackets having mounting holes, slots, scalloped edges, apertures, or the like to facilitate mounting of the brackets to the cabinet 12, the cabinet drawer(s) 38*a,b*, and/or a floor, and also may include track followers 68, which may include rollers, other tracks or linear guides or portions thereof, pins, shoes, or any other type of track followers suitable for cooperating with corresponding tracks to facilitate linear and pivotable motion. The supports 60*a,b* and 61*a,b* and the tracks 40*a,b* and 41*a,b* may be coupled to the cabinet 12 and the drawer modules 36*a,b* using separate fasteners or retainers, integral fastening arrangements, adhesive, and/or in any other manner suitable for use with cabinet hardware. In this regard, the drawer ends 64*a,b* and 65*a,b* of the supports 60*a,b* and 61*a,b* may include track followers 68 carried in the drawer module tracks 40*a,b* and 41*a,b*, and the tracks 40*a,b* and 41*a,b* may extend over the majority of the length of the top walls 48*a,b* and bottom walls 50*a,b* of the module frames 38*a,b*, from a location at or near the front walls 54*a,b* to a location at or near the rear walls 52*a,b*. Those of ordinary skill in the art will recognize that, conversely, the tracks 40*a,b* and 41*a,b* could be carried by the cabinet housing 12 and the followers 68 could be carried by the drawer modules 36*a,b*.

In any case, the tracks 40*a,b* and 41*a,b* and the track followers may constitute examples of portions of drawer articulators coupled to the cabinet housing 12 (or the countertop and/or a floor) and to the drawer frames 38*a,b*, such that the drawer modules 36*a,b* are translatable via the drawer articulators from the stored position to the extended position with respect to the cabinet housing 12, and are pivotable about vertical axes to a deployed, spread-apart open position with respect to one another and the housing 12. Accordingly, portions of upper drawer articulators are coupled to the drawer frames 38*a,b* such as the top walls 48*a,b* thereof, and portions of lower drawer articulators are coupled to the drawer frames 38*a,b* such as the bottom walls 50*a,b* thereof. In the illustrated embodiment, upper tracks 40*a,b* of upper drawer articulators are coupled to top walls 48*a,b* of the drawer frames 38*a,b*, and upper supports 60*a,b* are coupled to corresponding upper portions of the cabinet frames 38*a,b* or countertop 20 and include track followers 68 to cooperate with the upper tracks 40*a,b* to facilitate articulation of the drawer modules 36*a,b* relative to the cabinet 12. Likewise, lower tracks 41*a,b* of lower drawer articulators are coupled to bottom walls 50*a,b* of the drawer frames 38*a,b*, and lower supports 61*a,b* are coupled to corresponding lower portions of the cabinet frames 38*a,b* and include track followers 68 to cooperate with the lower tracks 41*a,b* to facilitate articulation of the drawer modules 36*a,b* relative to the cabinet 12.

Also, in the illustrated embodiment, the drawer frame front walls 54*a,b* are disposed at acute angles with respect to the drawer frame side walls 46*a,b*, and the rear walls 52*a,b* are disposed at right angles with respect to the side walls 46*a,b*. In other embodiments, the rear walls 52*a,b* may be disposed at obtuse angles with respect to the side walls 46*a,b*, and the front walls 54*a,b* may be disposed at right angles with respect to the side walls 46*a,b*. Moreover, each drawer module 36*a,b* may also include one or more shelves 70*a,b*, which may be supported by the rear walls 52*a,b* and front walls 54*a,b*, such that the corner drawer modules 36*a,b* may be mirrored shelving modules. The shelves 70*a,b* and the bottom wall may include inboard lips to prevent items from sliding off of those structures.

Although not illustrated, in another embodiment, a corner drawer may include a unitary single drawer instead of the illustrated drawer modules 36*a,b* wherein the single drawer may be drawn out of the cabinet 10 and then pivoted to one side to allow access to an inside of the single drawer.

FIGS. 4 through 11 illustrate another illustrative embodiment of a corner cabinet 110. This embodiment is similar in many respects to the embodiment of FIGS. 1 through 3 and like numerals between the embodiments generally designate like or corresponding elements throughout the several views of the drawing figures. Accordingly, the descriptions of the embodiments are hereby incorporated into one another, and description of subject matter common to the embodiments generally may not be repeated.

Figure 4:
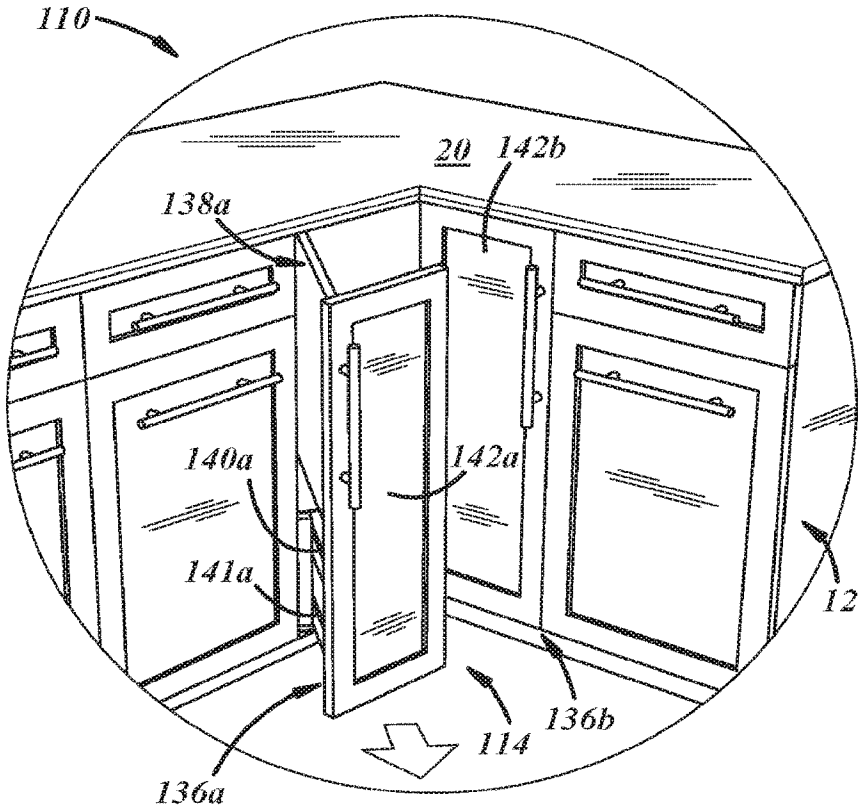
FIG. 4 is a fragmentary perspective view according to another illustrative embodiment of a corner cabinet of the present disclosure, and illustrating a cabinet housing, a countertop, and a left corner drawer module being opened and a closed right corner drawer module.

With reference to FIG. 4, the corner cabinet 110 includes the cabinet housing 12 and countertop 20 described previously, and also includes a presently disclosed corner drawer 114 carried by the cabinet housing 12 and constructed and operated according to the presently disclosed embodiment. The corner drawer 114 includes corner drawer modules 136*a,b*, which, as illustrated, may be independently translatable with respect to one another. Likewise, as will be described further herein below, the drawer modules 136*a,b*, also may be independently pivotable. In any case, the modules 136*a,b* will be described with reference to a left module 136*a*. The module 136*a* includes a frame 138*a*, one or more tracks 140*a*, 141*a* coupled to the frame 138*a*, and a front door 142*a* coupled to the frame 138*a*.

Figure 5:
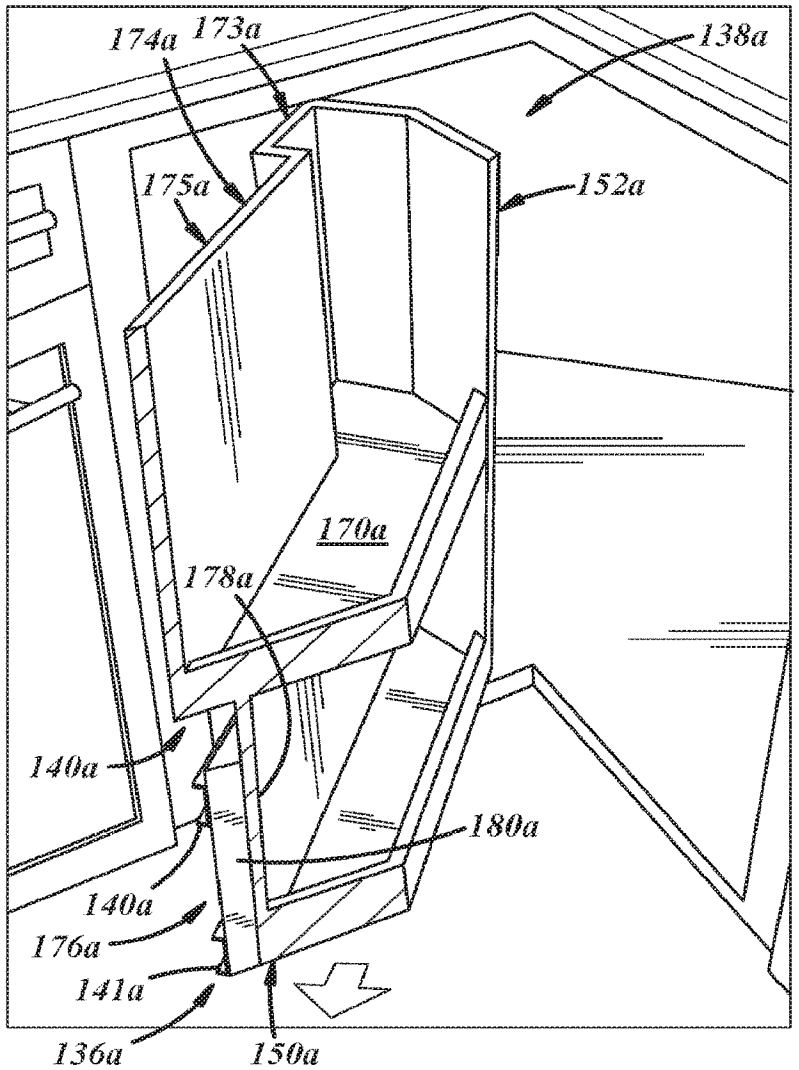
FIG. 5 is an enlarged fragmentary perspective view of the corner cabinet of FIG. 4, omitting the right corner drawer module, and illustrating the left corner drawer module in a partially extended position.

With reference to FIG. 5, the frame 138*a* includes a plurality of walls including a side wall 146*a*, a bottom wall 150*a*, a rear wall 152*a*, and a shelf 170*a*. The rear wall 152*a* may be disposed at an acute angle to the side wall 146*a*. The side wall 146*a* may include an upper side wall 174*a* establishing an outboard side of the drawer frame 138*a* and a lower side wall 176*a* laterally offset from the upper side wall 174*a* in an inboard direction and carrying the tracks 140*a*, 141*a*. The lower side wall 176*a* may be a single component or may include a drawer panel 178*a* and a shim 180*a* coupled to an outboard side of the drawer panel 178*a* and carrying the tracks 140*a*, 141*a*. Also, the upper side wall 174*a* may include a rearward portion 173*a* and a forward portion 175*a* laterally offset from the rearward portion 173*a* in an inboard direction. One or more of the offsets of the side wall 146*a* facilitate pivoting of the drawer module 136*a* to a wider angle against an adjacent portion of the cabinet 10 than otherwise would be possible.

In any case, the tracks 140*a*, 141*a* may constitute examples of portions of a drawer articulator coupled to the cabinet housing 12 (or the countertop and/or a floor) and to the drawer frame 138*a*, such that the drawer module 136*a* is translatable via the drawer articulator from the stored position to the extended position with respect to the cabinet housing 12, and is pivotable about a vertical axis to a deployed, spread-apart or spread open position. The drawer articulator includes a side drawer support 160*a* coupled between the drawer frame 138*a* and the cabinet housing 12 and the tracks 140*a*, 141*a* carried by the side wall 146*a* of the drawer frame 138*a*. The tracks 140*a*, 141*a* may be fixed to the drawer frame 138*a* against movement with respect thereto and may be carried, respectively, by the lower side wall 176*a* of the frame 138*a*.

Figure 6:
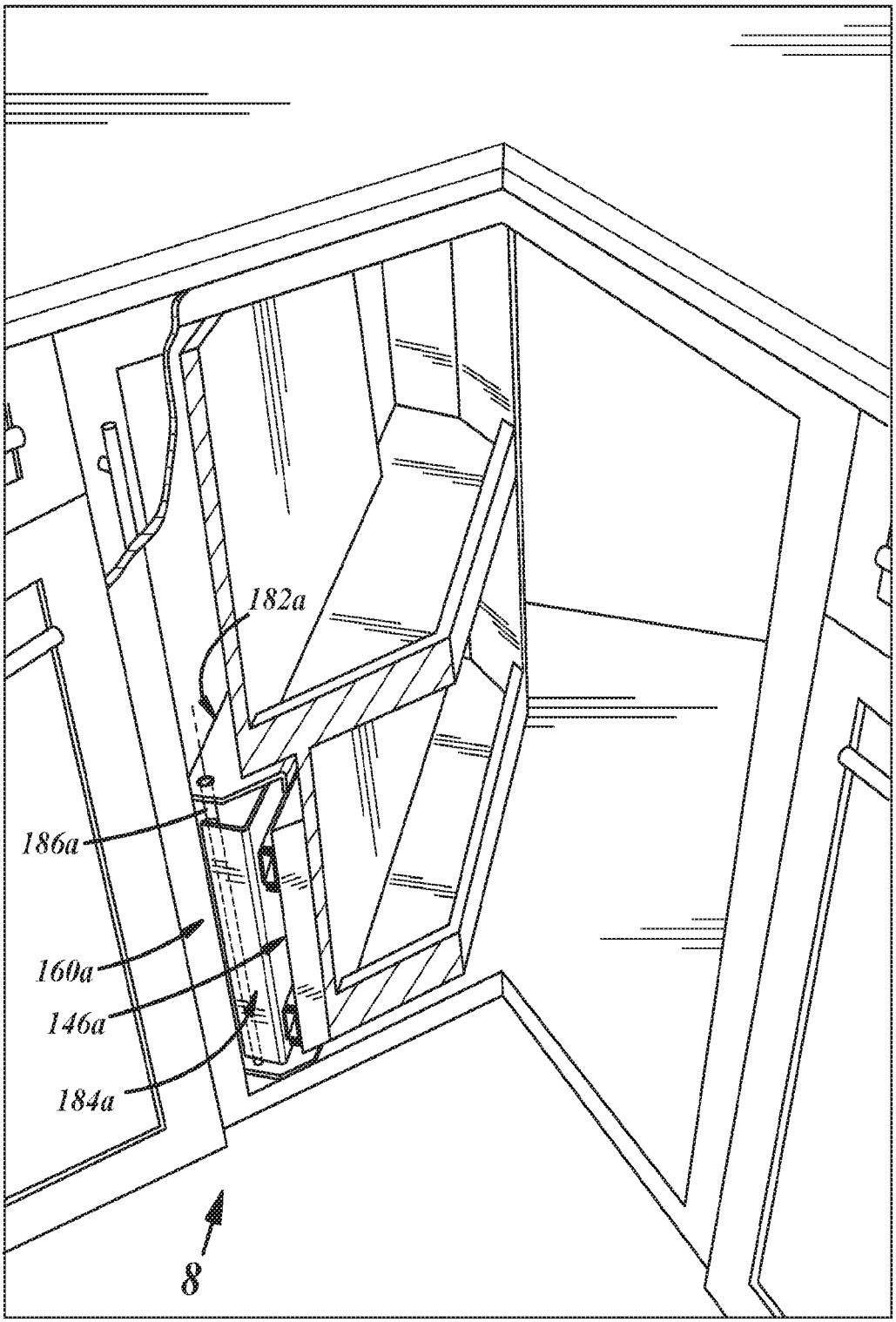
FIG. 6 is a fragmentary perspective view of the corner cabinet of FIG. 4, and illustrating the left corner drawer module in a closed position and showing a portion of an articulator.
Figure 7:
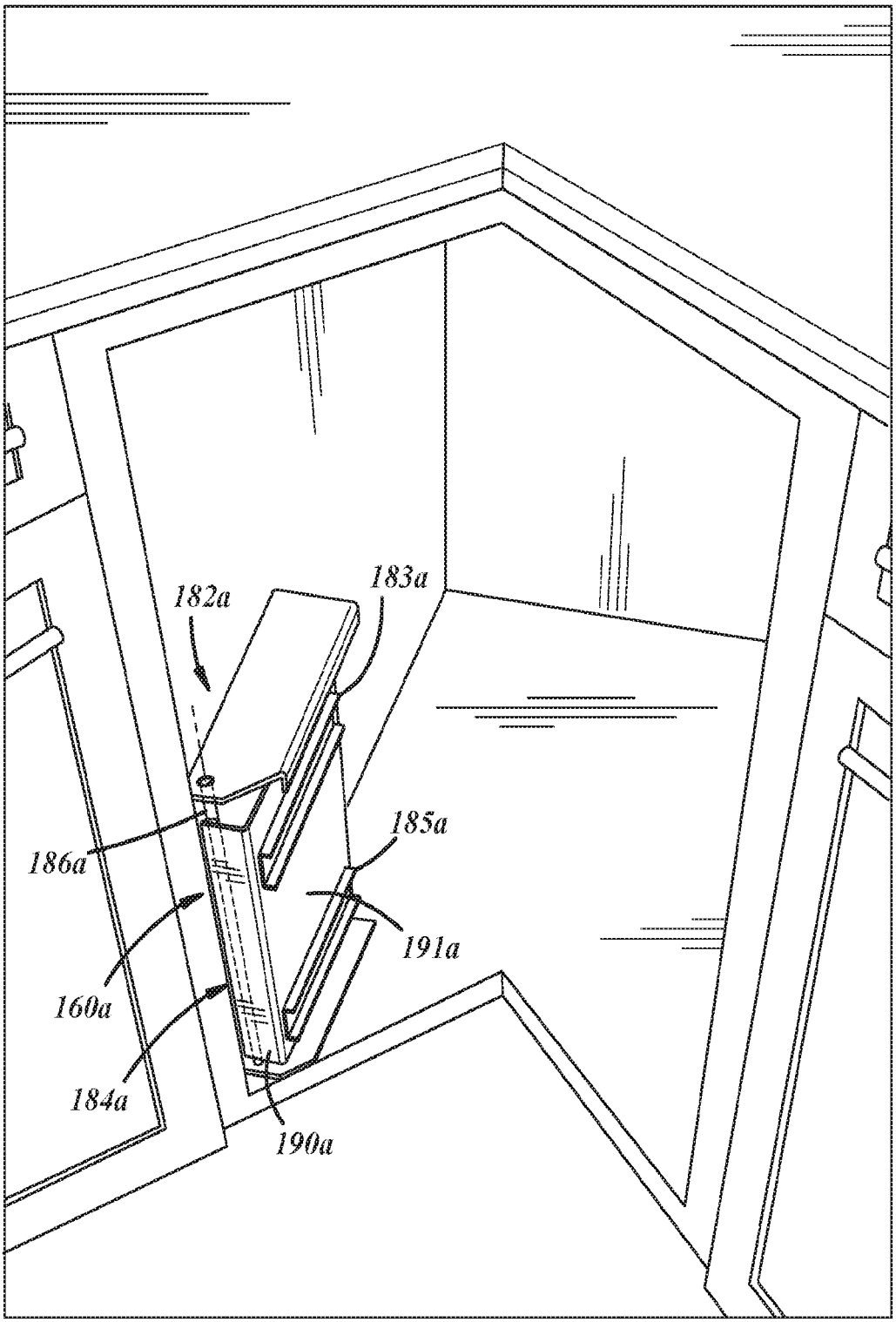
FIG. 7 is a fragmentary perspective view of the corner cabinet of FIG. 4, omitting the left and right corner drawer modules and illustrating the left articulator.

With reference to FIGS. 6 and 7, the side drawer support 160*a* includes a cabinet bracket 182*a* coupled to the cabinet housing 12, and a drawer bracket 184*a* coupled to the drawer module 136*a* and pivotably coupled to the cabinet bracket 182*a* about a vertical axis, e.g. via a hinge 186*a*. The cabinet bracket 182*a* may be fixed to a side wall 13*a* of the cabinet housing 12. The drawer bracket 184*a* may be translatably coupled to the side wall 146*a* of the drawer frame 138*a*. The drawer bracket 184*a* carries upper and lower followers 183*a*, 185*a* on which the tracks 140*a*, 141*a* (FIG. 5) of the drawer module 136*a* are translatably carried. The followers 183*a*, 185*a* may include linear guides, tracks, or any other componentry suitable to facilitate translation of the drawer module 136*a* with respect to the cabinet housing 12. The followers 183*a*, 185*a* and/or the tracks 140*a*, 141*a* may include bearings, rollers, or any other suitable rolling elements.

Figure 8:
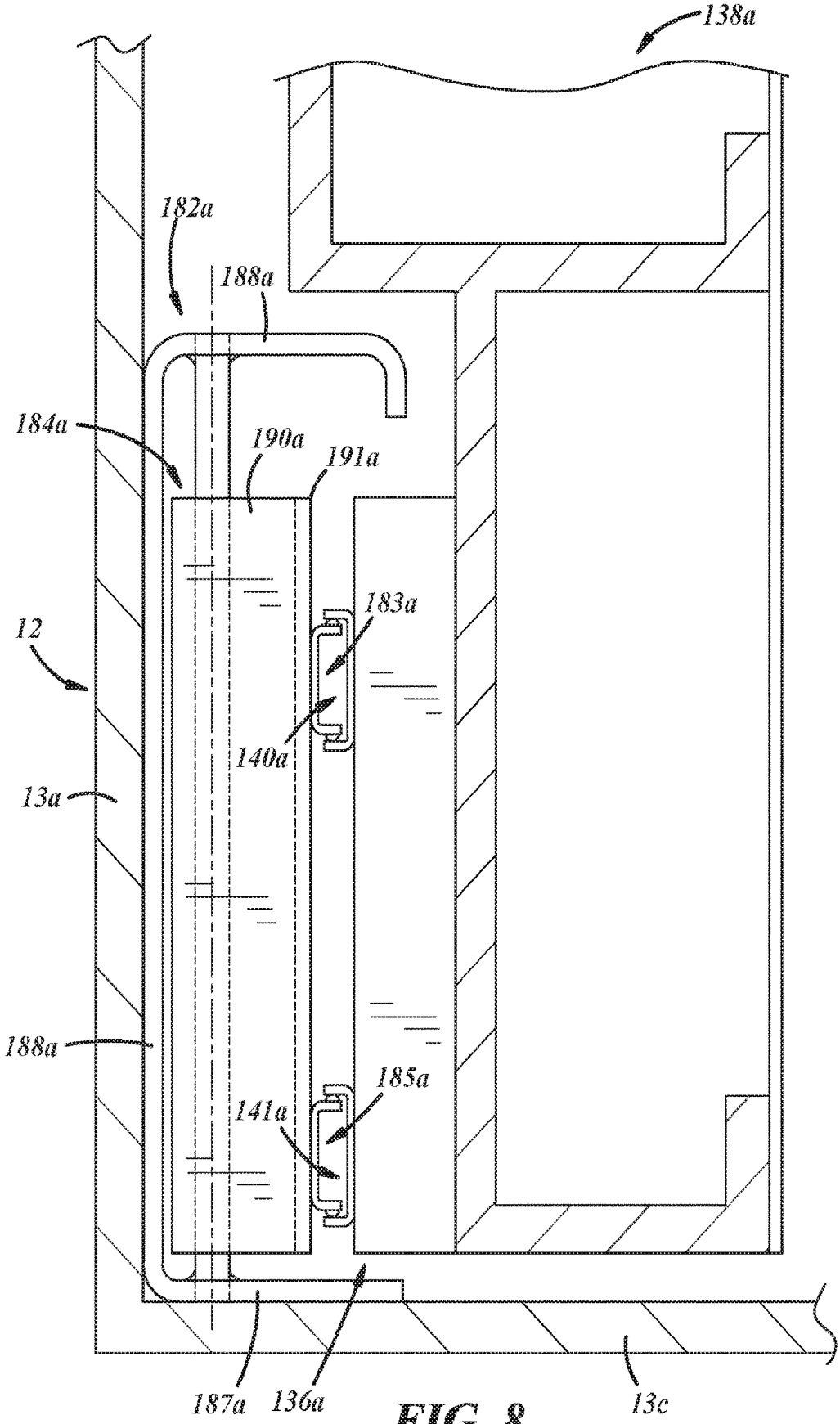
FIG. 8 is an enlarged, fragmentary, sectional front end view of the corner cabinet of FIG. 4, illustrating the left corner drawer module in a closed position.

With reference to FIG. 8, the cabinet bracket 182*a* may include a base wall 188*a* coupled to an inboard surface of the side wall 13*a* of the housing 12, a lower wall 187*a* extending inboard from the base wall 188*a* and coupled to an upper surface of a lower wall 13*c* of the housing 12, and an upper wall 189*a* extending inboard from the base wall 188*a*. The lower wall 187*a* may be fixed to the housing 12 via fasteners or in any other suitable manner. The drawer bracket 184*a* may include a base wall 190*a* and a mounting flange 191*a* extending away from the base wall 190*a* at a right angle with respect thereto. The base wall 190*a* of the drawer bracket 184*a* may carry the hinge 186*a*, which may be pivotably coupled to the lower and upper walls 187*a*, 189*a* of the cabinet bracket 182*a*. The mounting flange 191*a* of the drawer bracket 184*a* may be translatably coupled to the drawer module 136*a*, via the cooperating followers 183*a*, 185*a* and tracks 140*a*, 141*a*, or via any other arrangement suitable for translatable motion.

Figure 9:
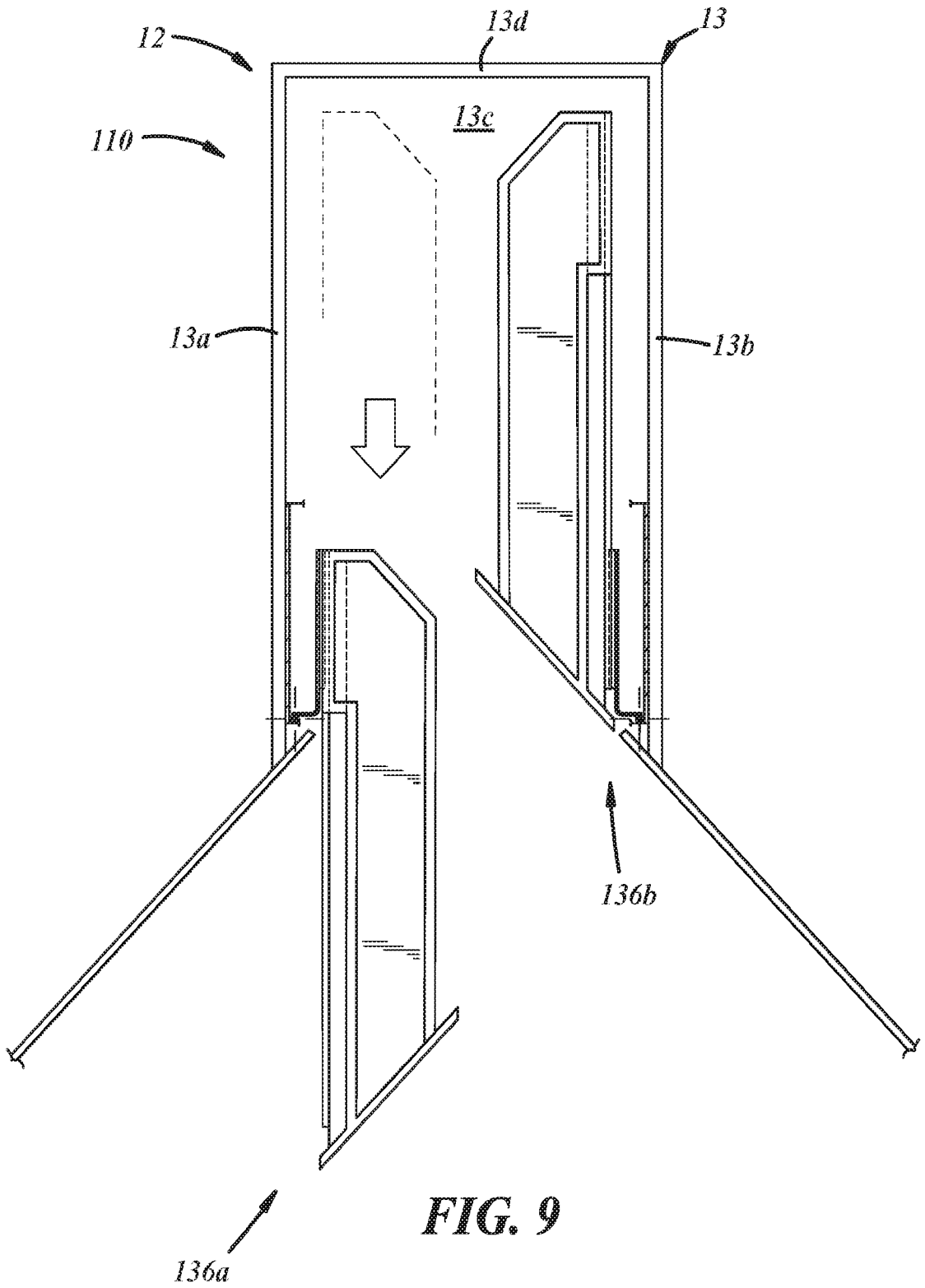
FIG. 9 is a fragmentary top view of the corner cabinet of FIG. 4, illustrating the right corner drawer module in a closed position and the left corner drawer module in an extended position.

With reference to FIG. 9, the left drawer module 136*a* may be extended out of the cabinet 12 while the right drawer module 136*b* may remain in a stored position in the cabinet 12. Accordingly, the drawer modules 136*a,b* may be independently extendable. Also, the cabinet 12 may include a corner cabinet housing 13, which may include the side walls 13*a,b*, the lower wall 13*c*, and a rear wall 13*d*, which, as illustrated, may extend at a right angle with respect to the side walls 13*a,b* and with respect to the extension and retraction direction of the drawer 114. In other embodiments, the rear wall 13*d* may include a rear corner wall including converging left and right portions extending at acute angles with respect to the side walls 13*a,b*.

Figure 10:
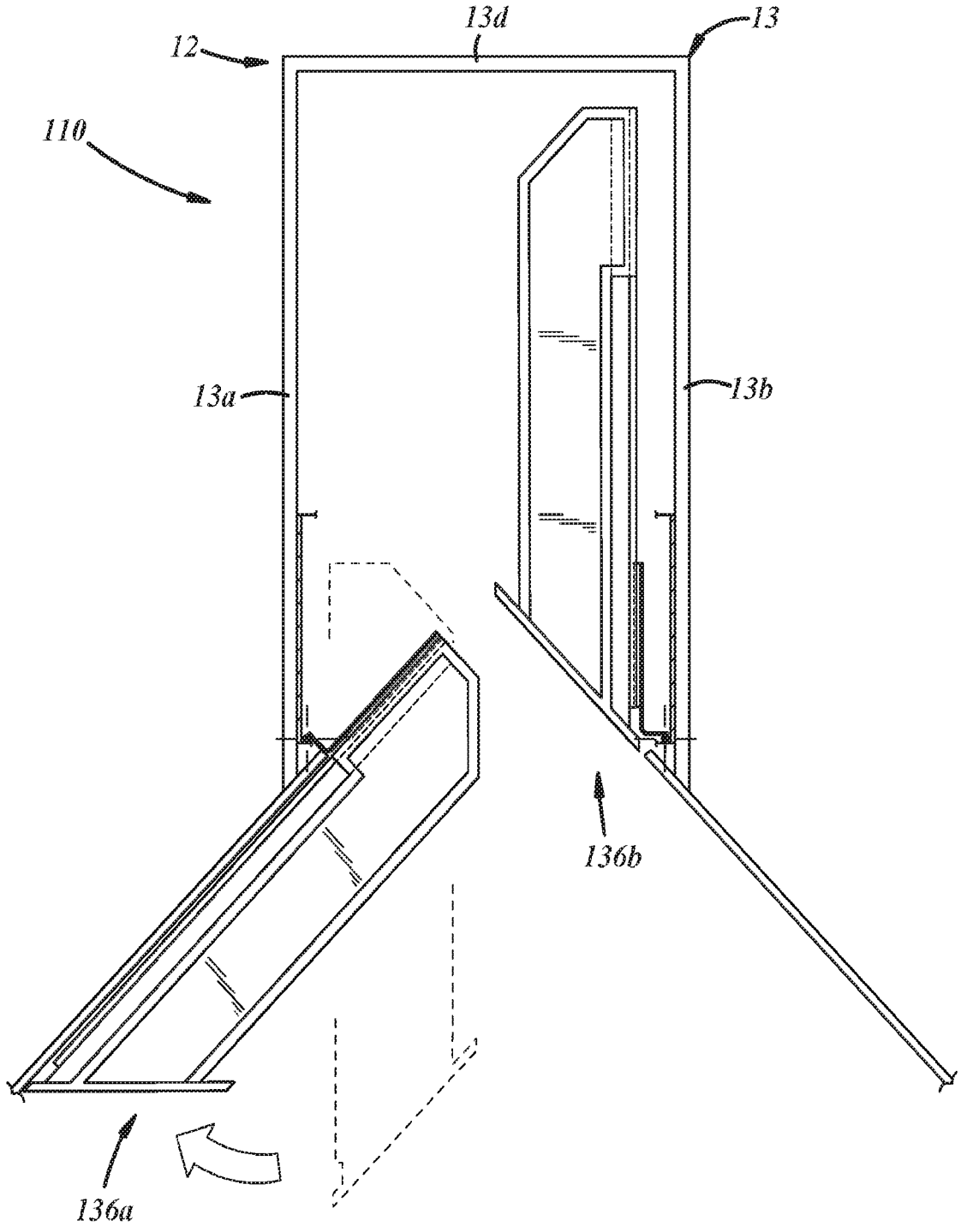
FIG. 10 is a fragmentary top view of the corner cabinet of FIG. 4, illustrating the right corner drawer module in a closed position and the left corner drawer module in a deployed position, extended and pivoted to a spread open position.
Figure 11:
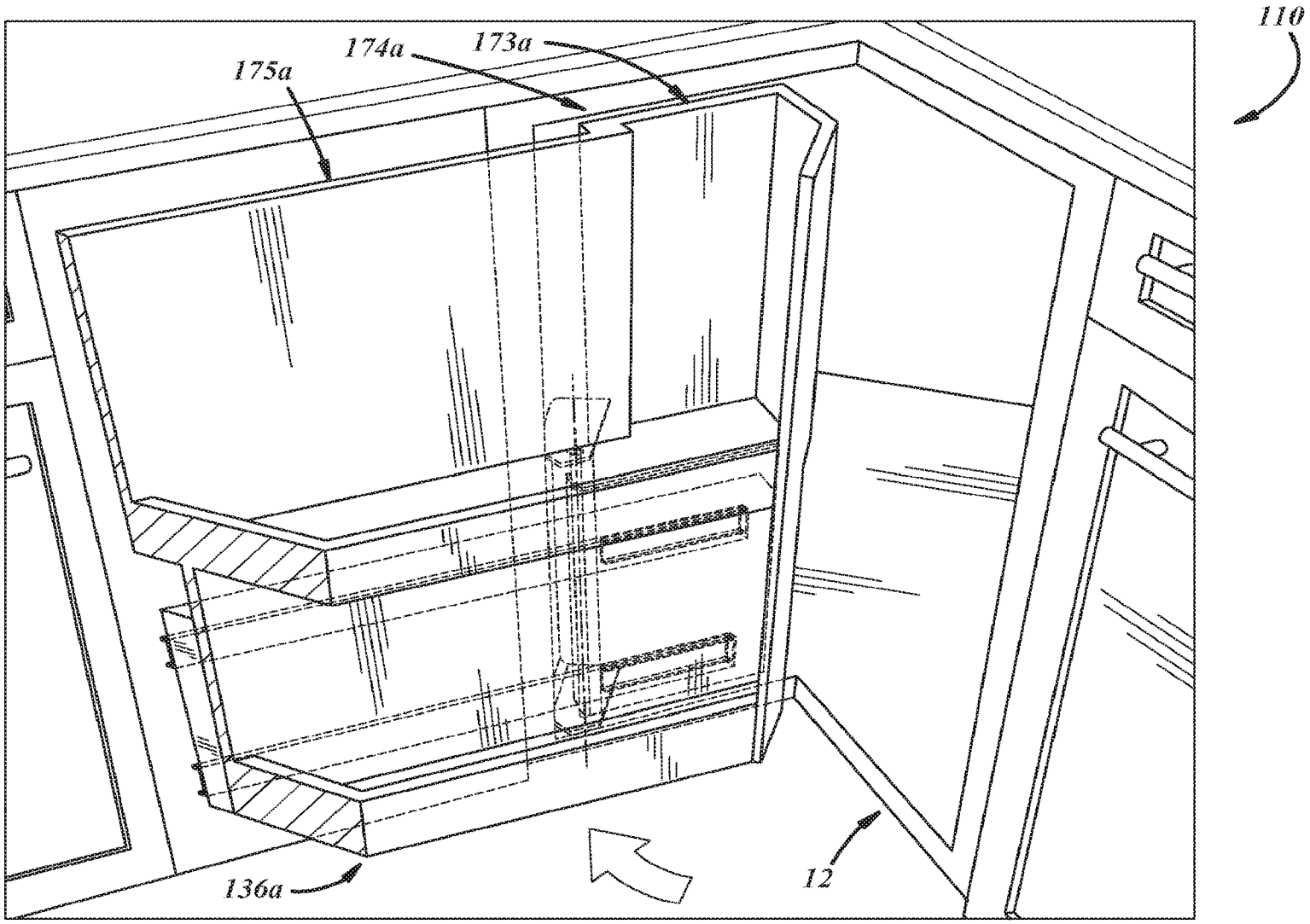
FIG. 11 is an enlarged fragmentary perspective view of the corner cabinet of FIG. 4, omitting the right corner drawer module, and illustrating the left corner drawer module in the deployed position.

With reference to FIGS. 10 and 11, the left drawer module 136*a* may be pivoted from its extended position to a spread open position, again, while the right drawer module 136*b* may remain in a stored position in the cabinet 12. Accordingly, the drawer modules 136*a,b* may be independently pivotable. Likewise, and although not shown, with the left drawer module 136*a* in the spread open position, the right drawer module 136*b* may be extended out of the cabinet 12 and then pivoted to a spread open position.

Those of ordinary skill in the art will recognize that various features and aspects from the embodiments of FIGS. 1-3 and FIGS. 4-11 could be interchanged including, but not limited to, the articulators, and the drawer frame side walls and other features of the drawer frames.

The configuration of the presently disclosed corner drawers may enable easier access to items stored throughout a full depth of a corner cabinet and more efficient use of interior storage space than some conventional corner cabinets.

As used in this patent application, the terminology "for example," "for instance," "like," "such as," "comprising," "having," "including," and the like, when used with a listing of one or more elements, is open-ended, meaning that the listing does not exclude additional elements. Likewise, when preceding an element, the articles "a," "an," "the," and "said" mean that there are one or more of the elements. Moreover, directional words such as front, rear, top, bottom, upper, lower, radial, circumferential, axial, lateral, longitudinal, vertical, horizontal, transverse, and/or the like are employed by way of example and not limitation. As used herein, the term "may" is an expedient merely to indicate optionality, for instance, of an element, feature, or other thing, and cannot be reasonably construed as rendering indefinite any disclosure herein. Other terms are to be interpreted and construed in the broadest reasonable manner in accordance with their ordinary and customary meaning in the art, unless the terms are used in a context that requires a different interpretation.

Finally, the present disclosure is not a definitive presentation of an invention claimed in this patent application, but is merely a presentation of examples of illustrative embodiments of the claimed invention. More specifically, the present disclosure sets forth one or more examples that are not limitations on the scope of the claimed invention or on terminology used in the accompanying claims, except where terminology is expressly defined herein. And although the present disclosure sets forth a limited number of examples, many other examples may exist now or are yet to be discovered and, thus, it is neither intended nor possible to disclose all possible manifestations of the claimed invention. In fact, various equivalents will become apparent to artisans of ordinary skill in view of the present disclosure and will fall within the spirit and broad scope of the accompanying claims. Features of various implementing embodiments may be combined to form further embodiments of the invention. Therefore, the claimed invention is not limited to the particular examples of illustrative embodiments disclosed herein but, instead, is defined by the accompanying claims.

The invention claimed is:

1. A corner cabinet drawer comprising:

first and second drawer modules including first and second drawer frames having first and second side walls, first and second rear walls, and first and second front walls, wherein the first and second drawer modules are pivotable between a side-by-side closed position and a spread open position, wherein the side walls, rear walls, and front walls establish closed outboard sides and open inboard sides facing one another when the first and second drawer modules are in the side-by-side closed position; and front doors disposed at acute angles to the first and second side walls.

2. The corner cabinet drawer of claim 1, wherein the first and second drawer modules also include upper and lower tracks.

3. The corner cabinet drawer of claim 1, wherein the first and second drawer modules include shelves to constitute shelving modules.

4. The corner cabinet drawer of claim 1, wherein the open inboard sides also face one another in an extended side-by-side closed position.

5. The corner cabinet drawer of claim 1, wherein the drawer frame rear walls are disposed at right angles to the first and second side walls.

6. The corner cabinet drawer of claim 1, wherein the drawer frame rear walls are disposed at acute angles to the first and second side walls.

7. The corner cabinet drawer of claim 1, wherein the first and second drawer modules are independently translatable, and independently pivotable about separate vertical axes.

8. A corner cabinet drawer, comprising:

first and second drawer modules including first and second drawer frames having first and second side walls, first and second rear walls, and first and second front walls, wherein the first and second drawer modules are pivotable between a side-by-side closed position and a spread open position, and a hinge extending along a common vertical axis operatively between and inboard of the first and second drawer modules and pivotably coupling the first drawer module to the second drawer module about the vertical axis.

9. A corner cabinet drawer, comprising:

first and second drawer modules including first and second drawer frames having first and second side walls, first and second rear walls, and first and second front walls, wherein the first and second drawer modules are pivotable between a side-by-side closed position and a spread open position, and wherein the drawer frame side walls include upper side walls establishing outboard sides of the first and second drawer frames and lower side walls laterally offset from the upper side walls in an inboard direction and carrying tracks.

10. The corner cabinet drawer of claim 9, wherein the upper side walls include rearward portions and forward portions laterally offset from the rearward portions in an inboard direction.

11. An articulatable corner drawer module, comprising:

a drawer frame comprising a side wall, and top, bottom, rear, and front walls extending away from the side wall and establishing an open side;

at least a portion of an upper drawer articulator coupled to the drawer frame;

at least a portion of a lower drawer articulator coupled to the drawer frame; and a hinge coupled to rear inboard corners of the first and second drawer frames of each of the drawers.

12. The articulatable corner drawer module of claim 11, wherein the front wall is disposed at an acute angle with respect to the side wall, and the rear wall is disposed at a right angle with respect to the side wall.

13. The articulatable corner drawer module of claim 11, further comprising shelves supported by the rear and front walls.

14. An articulatable corner cabinet drawer comprising two of the articulatable corner drawer modules of claim 11 that are minor images of one another.

15. The articulatable corner drawer module of claim 11, wherein the at least a portion of an upper drawer articulator includes an upper drawer track carried by the top wall of the drawer frame, and the at least a portion of a lower drawer articulator includes a lower drawer track carried by the bottom wall of the drawer frame.

16. A corner cabinet, comprising:

a corner cabinet housing including left and right portions having drawers; and an articulatable corner drawer module comprising:

a drawer frame comprising a side wall, and bottom, rear, and front walls extending away from the side wall and establishing an open side; and at least a portion of a side drawer articulator coupled to the drawer frame, and including a cabinet bracket, a drawer bracket coupled to the side wall of the drawer frame and pivotably coupled to the cabinet bracket, and tracks and followers operatively coupled to one another and to the drawer bracket and the side wall of the drawer frame, the articulatable corner drawer module translatably and pivotably mounted with respect to the corner cabinet housing by the side drawer articulator in a corner location between the left and right portions of the corner cabinet housing, wherein the side drawer articulator is coupled to the corner cabinet housing, and wherein the drawer frame is translatable via the side drawer articulator from a stored position with respect to the corner cabinet housing to an extended position with respect to the corner cabinet housing, and is pivotable about a vertical axis to a deployed position, wherein the side wall of the drawer frame is offset to facilitate pivoting of the drawer module.

17. The corner cabinet of claim 16, wherein the corner cabinet housing also includes a corner wall having an opening to accommodate extension of the corner drawer therethrough.

* * * * *